US011396733B2

(12) United States Patent
Kollmann

(10) Patent No.: US 11,396,733 B2
(45) Date of Patent: Jul. 26, 2022

(54) QUICK-CHANGE COUPLER DEVICE

(71) Applicant: OilQuick Deutschland KG, Steindorf (DE)

(72) Inventor: Michael Kollmann, Egling an der Paar (DE)

(73) Assignee: OilQuick Deutschland KG, Steindorf (DE)

( * ) Notice: Subject to any disclaimer, the term of this patent is extended or adjusted under 35 U.S.C. 154(b) by 473 days.

(21) Appl. No.: 16/451,190

(22) Filed: Jun. 25, 2019

(65) Prior Publication Data

US 2020/0002913 A1 Jan. 2, 2020

(30) Foreign Application Priority Data

Jul. 2, 2018 (DE) ..... 10 2018 115 949.8
Oct. 9, 2018 (EP) ..... 18199339

(51) Int. Cl.
*E02F 3/36* (2006.01)

(52) U.S. Cl.
CPC ..... *E02F 3/3622* (2013.01); *E02F 3/3618* (2013.01)

(58) Field of Classification Search
None
See application file for complete search history.

(56) References Cited

U.S. PATENT DOCUMENTS 5,692,855 A * 12/1997 Burton ..... E02F 3/3631 172/272
6,379,075 B1 4/2002 Shamblin et al.
(Continued)

FOREIGN PATENT DOCUMENTS

AU 2009201972 A1 11/2009
DE 20 2006 018263 U1 2/2007
(Continued)

OTHER PUBLICATIONS

Search Results for German Application No. 10 2018 115 949.8, dated Mar. 12, 2019.
(Continued)

*Primary Examiner* — Michael S Lowe
(74) *Attorney, Agent, or Firm* — Paul D. Bianco; Gary S. Winer; Fleit Intellectual Property Law

(57) ABSTRACT

A quick-change coupler device for coupling and uncoupling an implement attachment to a construction vehicle comprises a support member; first receiving members on one side of the support member for receiving a first coupling member; second receiving members disposed on the other side for receiving a second coupling member, the second receiving members having a locking member moveable between a release position for coupling or uncoupling the implement attachment and a coupling position for retaining the implement attachment on the coupler device; and a mechanical signaling mechanism for monitoring the locking status. The mechanical signaling mechanism comprises an assembly for signaling failure of the second coupling member to engage in the second receiving members. The assembly comprises a coupling gear for moving a signaling member into a locking position when the locking member moves into the coupling position, and into an unlocking position when the at least one locking member moves beyond the coupling position.

13 Claims, 10 Drawing Sheets

(56) References Cited

U.S. PATENT DOCUMENTS

| | | | | |
|---|---|---|---|---|
| 6,699,001 | B2 * | 3/2004 | Fatemi | E02F 3/3618 37/468 |
| 8,678,697 | B2 * | 3/2014 | Monaghan | E02F 3/3618 403/322.3 |
| 9,574,319 | B2 | 2/2017 | Seljestad | |

FOREIGN PATENT DOCUMENTS

| | | | |
|---|---|---|---|
| DE | 10 2015 009491 | A1 | 2/2016 |
| EP | 2573279 | A2 | 3/2013 |
| GB | 2447809 | A | 9/2008 |
| WO | 2011/019312 | A1 | 2/2011 |
| WO | 2016/153360 | A1 | 9/2016 |

OTHER PUBLICATIONS

European Search Report dated May 9, 2019 for Application No. EP18199339.

* cited by examiner

QUICK-CHANGE COUPLER DEVICE

FIELD OF THE DISCLOSURE

The disclosure relates to a quick-change coupler device. The disclosure further relates to a quick-change coupler system comprising this type of quick-change coupler device and a dedicated adapter.

BACKGROUND

Quick-change coupler devices of this type are used to easily and conveniently couple and uncouple different implement attachments to and from construction vehicles. Using this type of quick-change coupler device allows, e.g., tilt buckets, claws, shears, compactors, magnets, hydraulic hammers or other implement attachments to be coupled to and uncoupled from, e.g., a boom structure of an excavator, within a few seconds and at a high safety standard from the operator's cab.

U.S. Pat. No. 6,379,075 B1 discloses a generic quick-change coupler device. This quick-change coupler device comprises a support member which, on one side, has first receiving members for retaining a first coupling member disposed on an implement attachment and, on the other side, second receiving members with a locking member for releasably retaining a second coupling member, which locking member can be shifted between a release position and a locking position. The locking member has the configuration of a linearly movable hook slider which can be shifted between an open position and a closed position. Attached to the hook slider is a signaling rod which, in the closed position of the hook slider, is retracted into a casing and which, in the open position of the hook slider, projects outwardly beyond the casing. Although this type of signaling mechanism allows the position of the hook slider to be monitored, this signaling mechanism does not allow checking whether the coupling member is properly engaged in the hook slider.

SUMMARY

The disclosure relates to a quick-change coupler device of the type mentioned above and a quick-change coupler system comprising this type of quick-change coupler device, which allow improved monitoring to ensure a proper locking status.

Accordingly, a quick-change coupler device and a quick-change coupler system are disclosed herein. Expedient developments and advantageous refinements are also disclosed.

In an embodiment, the quick-change coupler device includes a mechanical signaling mechanism which comprises an assembly for signaling the failure of the second coupling member to be engaged in the second receiving members. This means that correct locking is signaled only if the second coupling member is also in the position required to ensure proper locking. Thus, monitoring and signaling proper locking does not only rely on the position of the at least one locking member, but also incorporates the position of the second coupling member. As a result, monitoring can be improved and the safety can be increased.

To signal the failure of the second coupling member to be engaged in the second receiving members, a signaling member, which is able to move between a locking position and an unlocking position, is provided. The assembly comprises a coupling gear for moving the signaling member into the locking position when the at least one locking member moves into the coupling position and for moving the signaling member back into the unlocking position when the at least one locking member moves beyond the coupling position.

The coupling gear conveniently comprises a control lever which is mounted on the support member so as to pivot about a hinge and which is connected to the signaling member via a jointed rod and a linearly movable rod. The control lever preferably has a control cam and a recess. The control cam and the recess can preferably be disposed on one arm of the control lever, and the jointed rod can be disposed on the other arm of the control lever. The linearly movable rod is conveniently movably guided in a guide and biased by a spring.

The control lever can be rotated via an actuating device through a cylinder provided for moving the at least one locking member. In a low-friction implementation, the actuating device can be a lever with a ball bearing.

In a configuration of the signaling member especially readily visible to the operator, the signaling member can be a flap which is pivotably mounted on a casing and which can be shifted by means of a linearly movable rod between an upwardly raised locking position and a downwardly lowered unlocking position. However, the signaling member can also be a bolt, which can move between a retracted and an extended position, or any another suitable signaling member.

In another implementation, the coupling gear can comprise a carriage, which is connected to the signaling member via a geared drive and which is able to move at right angles relative to the signaling member, and an actuating member which is detachably connected to the carriage. The carriage can be detachably connected to the actuating member, e.g., via a pivotable control lever. The two-arm control lever, which is pivotably mounted about an axis on the carriage, can have a lug on one arm for engagement in a groove of the actuating members and a guiding taper on the other for engagement with a guiding plane on a casing. The geared drive can comprise a lever which can be rotated by a gear wheel, an idler wheel meshing with the gear wheel, and a gear rack meshing with the idler wheel on the carriage.

The disclosure further relates to a quick-change coupler system comprising a quick-change coupler device described above and an adapter coupled to the quick-change coupler device.

BRIEF DESCRIPTION OF THE DRAWINGS

Additional characteristic features and advantages of the disclosure follow from the description of two preferred embodiment examples below with reference to the drawings. The drawings show.

DETAILED DESCRIPTION

Figure 1:
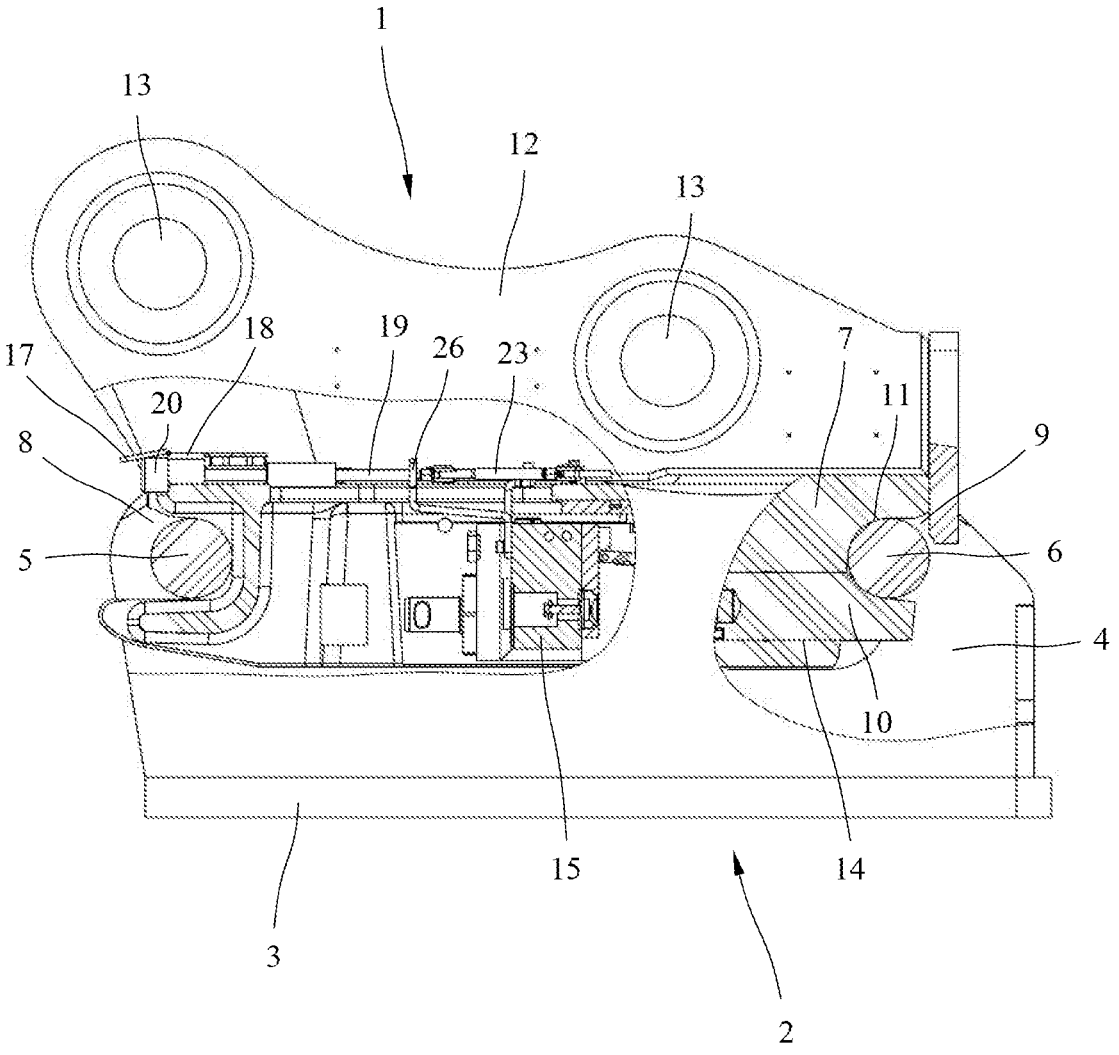
FIG. 1 a partially sectioned lateral view of a quick-change coupler system comprising a quick-change coupler device and an adapter in a coupling position.

FIG. 1 shows a quick-change coupler system for easily and conveniently coupling and uncoupling different implement attachments to and from construction vehicles, in particular from excavators, said system comprising a quick-change coupler device 1 and a dedicated adapter 2. Using a quick-change coupler device of this type allows, e.g., tilt buckets, claws, shears, magnets, compactors, hydraulic hammers or other mechanical and/or hydraulic implement attachments to be simply and conveniently coupled to and uncoupled from a boom structure or another implement attachment of an excavator or another construction vehicle from an operator's cab.

The adapter 2, which can be mounted on an implement attachment, comprises a base plate 3 and two parallel side walls 4, between which a first bolt-shaped coupling member 5 and, at a predefined distance therefrom, a second bolt-shaped coupling member 6 are disposed for the detachable connection to the quick-change coupler device 1. The two bolt-shaped coupling members 5 and 6 can be inserted into and affixed in complementary bores in the side walls 4.

Figure 2:
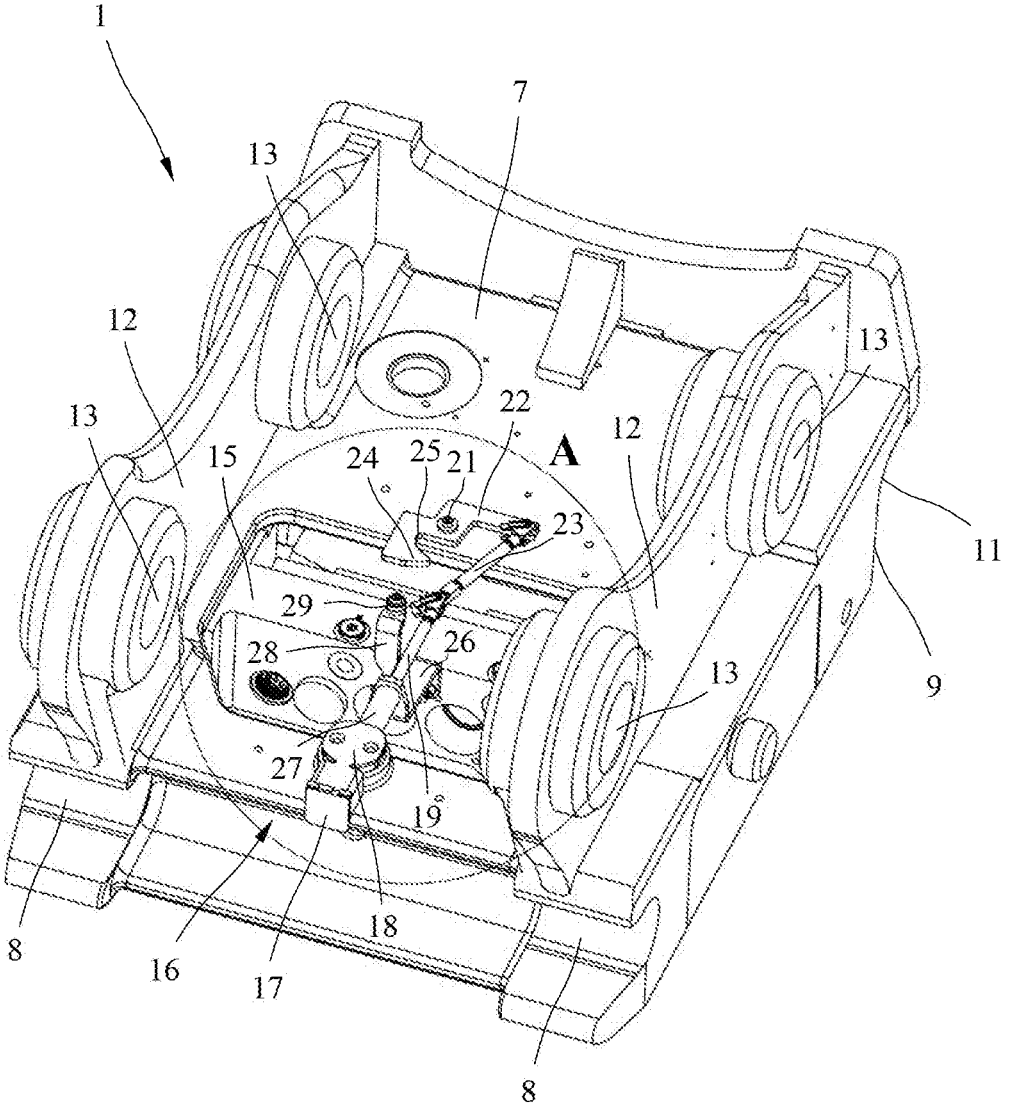
FIG. 2 a perspective view of the quick-change coupler device of FIG. 1 in a changeover position.

The quick-change coupler device 1, also shown from a perspective view in FIG. 2, comprises a support member 7 in the form of a welded or cast component, which, on one side, has frontwardly open first receiving members 8 for receiving and retaining the first bolt-shaped coupling member 5 and, on the other side, downwardly open second receiving members 9 with a locking member 10 shown in FIG. 1 for receiving and retaining the second bolt-shaped coupling member 6.

In the embodiment example illustrated, the quick-change coupler device 1, on one side of the support member 7, has two spaced apart receiving members 8 for the first coupling member 5 and, on the other side, two receiving members 9 for the second coupling member 6. The frontwardly open first receiving members 8 have a claw- or fork-shaped configuration. The downwardly open second receiving members 9 have a curved lower abutment surface 11, against which the second bolt-shaped coupling member 6 abuts. On its top side, the support member 7 has two parallel side sections 12 in which are provided continuous openings 13 for mounting bolts (not shown) for mounting the quick-change coupler device 1 to a boom structure of an excavator or a connector part of another construction vehicle.

Figure 5:
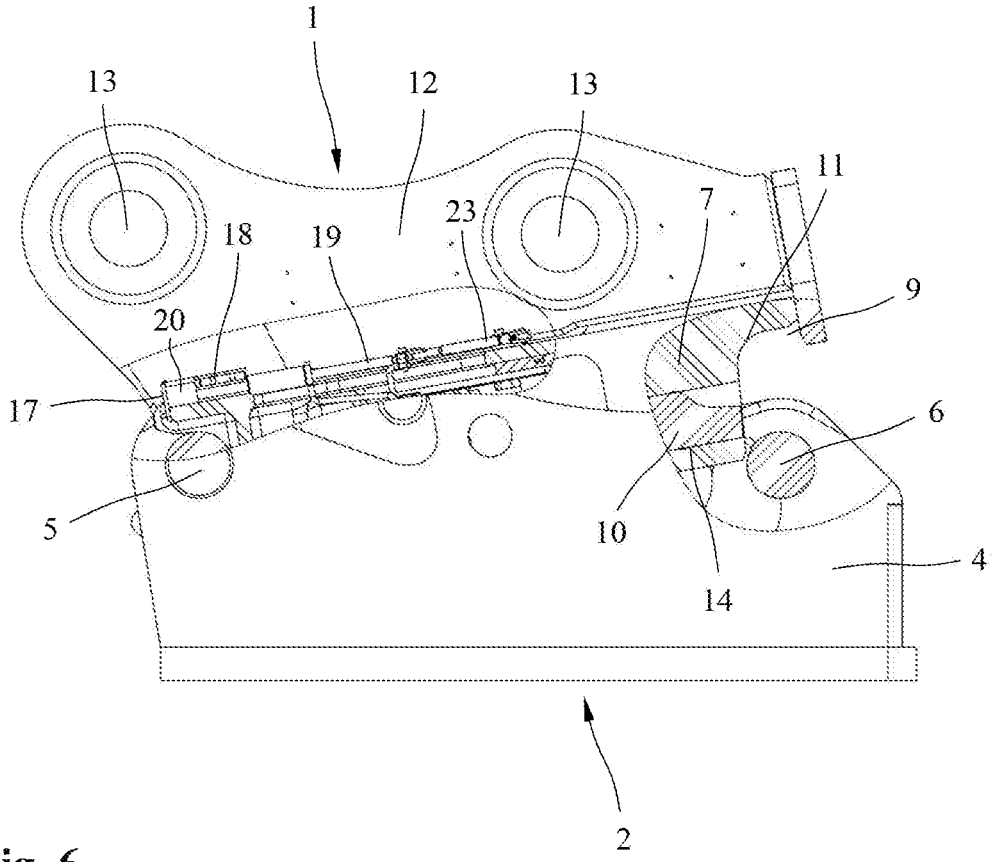
FIG. 5 a partially sectioned lateral view of the quick-change coupler system of FIG. 1 in a changeover position.
Figure 7:
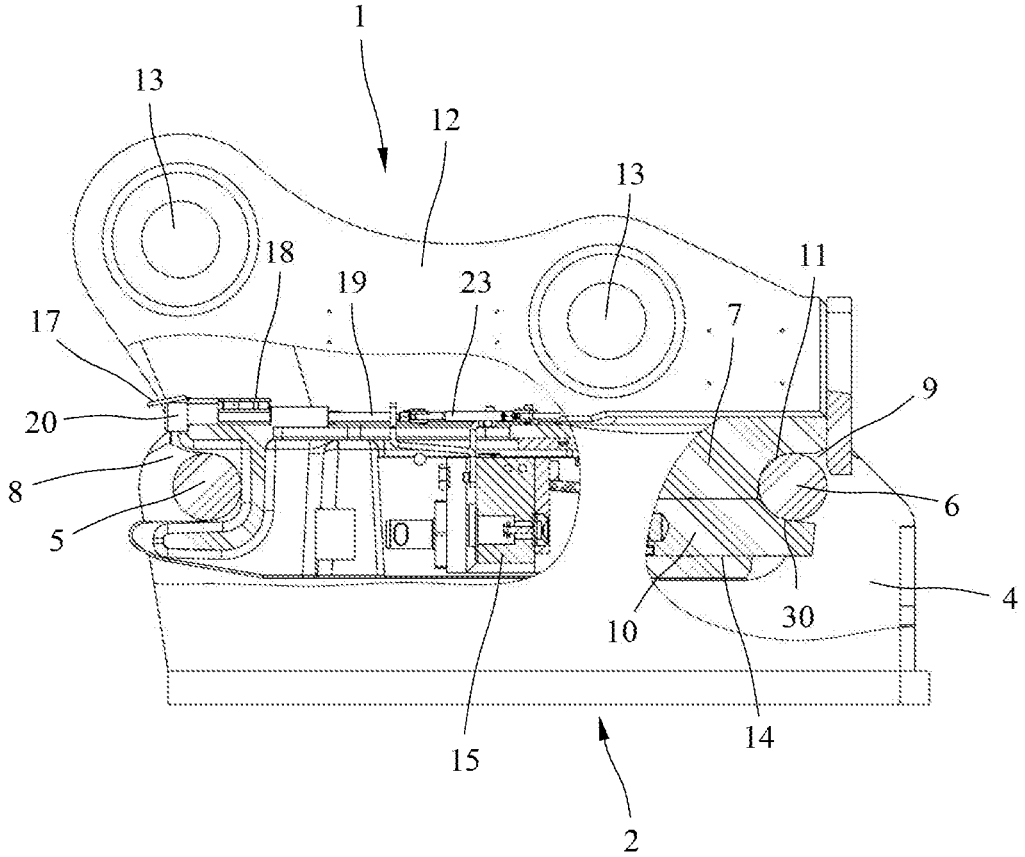
FIG. 7 a partially sectioned lateral view of the quick-change coupler system of FIG. 1 in a coupling position.

In the implementation shown, the quick-change coupler device 1 also comprises two locking members 10 in the configuration of locking bolts which according to FIG. 1 are movably guided in guide bores 14 of the support member 7 and both of which together are moved hydraulically through a cylinder 15, which is H-shaped in the top view, between a retracted release position shown in FIG. 5 for releasing or connecting an implement attachment and a locking position shown in FIG. 7. In the locking position of FIG. 7, the lower ends of the downward open second receiving members 9 are closed by the locking members 10 disposed in the guide bores 14, so that the second bolt-shaped coupling member 6 are engaged from below by the locking members 10.

To connect an implement attachment by means of the quick-change coupler device 1, the quick-change coupler device 1, which, as a rule, is disposed on a boom structure of an excavator, is first moved in such a way that a first coupling member 5, disposed, e.g., on an adapter or on the implement attachment, is retracted into the claw- or fork-shaped receiving members 8 on one side of the quick-change coupler device 1. Subsequently, the quick-change coupler device 1 with still retracted locking members 10 is swiveled about the first bolt-shaped coupling member 5 in such a way that the second coupling member 6 on the adapter or on the implement attachment comes to abut on the abutment surfaces 11 of the downwardly open receiving members 9 on the other side of the quick-change coupler device 1. Subsequently, the locking members 10 which are movably disposed in the guide bores 14 in the support member 7 of the quick-change coupler device 1 can be hydraulically extended outwardly, so that the second bolt-shaped coupling member 6 is engaged from below by the two locking members 10 on the quick-change coupler device 1 and the implement attachment is thus retained on the quick-change coupler device 1.

The quick-change coupler device 1 further comprises a mechanical signaling mechanism 16 for monitoring proper locking. As is shown especially in FIGS. 3 and 4, the mechanical signaling mechanism 16 has a means for signaling the failure of the second coupling member 6 to be properly engaged in the second receiving members 9. The mechanism for signaling that the second coupling member 6 is not engaged in the second receiving members 9 comprises a signaling member 17, which moves between a locking position and an unlocking position, and a coupling gear, by means of which the signaling member 17 is first moved into the locking position when the locking members 10 move into the coupling position. However, if, due to the failure of a coupling member 5 to be properly engaged, the locking members 10 move beyond the coupling position, the signaling member 17 is moved back into the unlocking position via the coupling gear. This allows the operator to be signaled that despite an actuation of the locking member 10, proper locking did not occur.

In the embodiment example shown, the signaling member 17 is a flap, which is pivotably mounted on a casing 18 and which, by means of a linearly moving rod 19, can be moved between an upwardly raised locking position, as shown in FIG. 1, and a downwardly lowered unlocking position, as shown in FIG. 5, via a bolt 20, which is guided inside the casing 18. In the locking position shown in FIG. 1, the bolt 20 protrudes outwardly beyond the casing 18 and raises the flap-type signaling member 17 upwardly. In the unlocking position, on the other hand, the bolt 20 is retracted into the casing 18, and the flap-type signaling member 17 is closed.

Thus, it is clearly visually observable from the outside, and especially from an operator's cab, whether the quick-change coupler device 1 is properly locked. However, the locking and unlocking position can also be signaled only by the bolt 20 without a flap.

Figure 3:
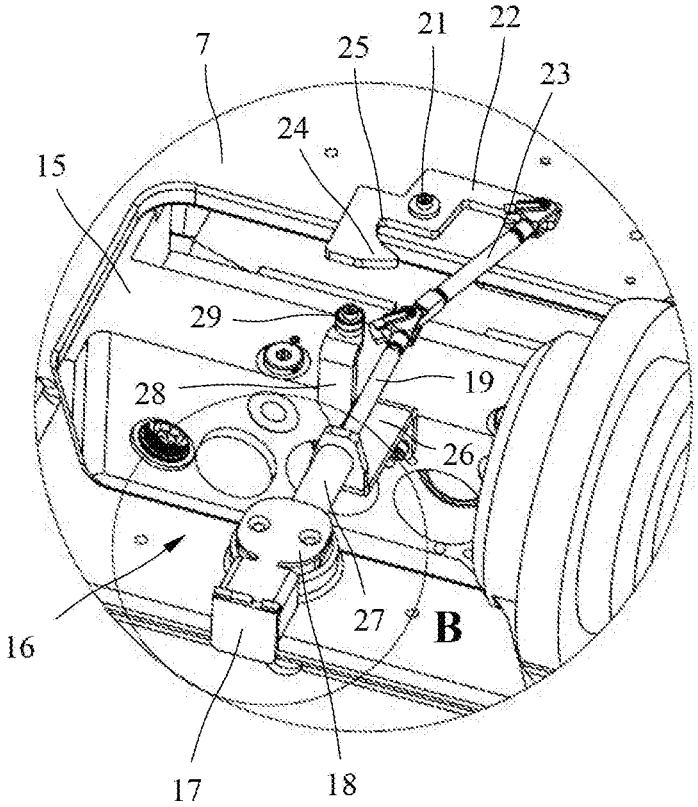
FIG. 3 an enlarged detail view A of FIG. 2.
Figure 4:
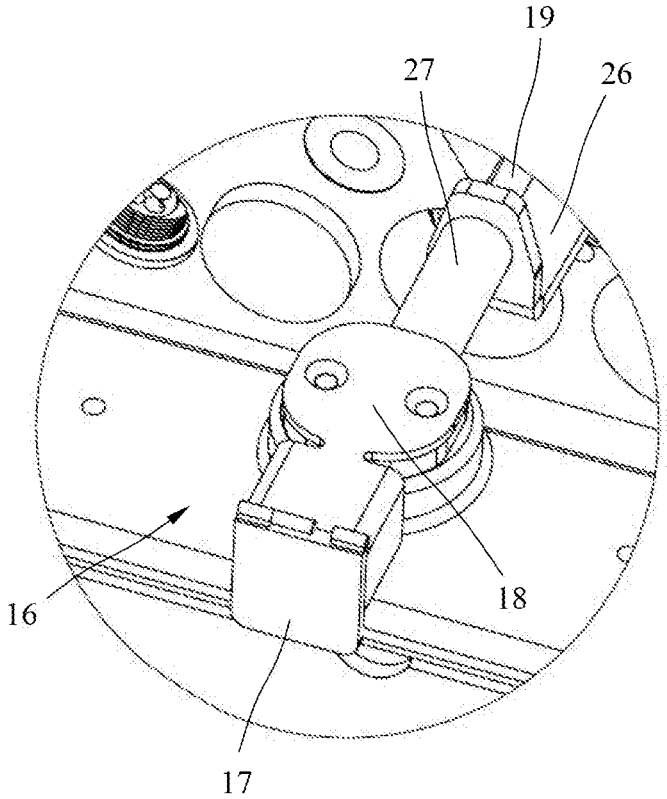
FIG. 4 an enlarged detail view B of FIG. 3.

As indicated especially in FIG. 3, the coupling gear, which is configured to connect the cylinder 15 and the signaling member 17, comprises a control lever 22 which is pivotably mounted about a hinge 21 on the support member 7 and which is connected via a jointed rod 23 to the linearly movable rod 19. On one of its arms, the control lever 22, which is pivotably mounted about the hinge 21, has a control cam 24 and a recess 25. Hinged to the other arm of the control lever 22 is one of the ends of the jointed rod 23. The other end of the jointed rod 23 is hinged to the linearly movable rod 19 so as to be able to move the signaling member 17. Via a guide 26, which is secured to the cylinder 15, the linearly movable rod 19 is slidably guided and pushed by a spring disposed inside a bushing 27 into the unlocking position shown in FIG. 3. In the implementation shown, the guide 26 has the configuration of a double-bend sheet metal part. By rotating the plate-shaped control lever 22, the rod 19 is linearly moved via the jointed rod 23. The control lever 22 is rotated through the cylinder 15 provided for moving the two locking members 10 via a lever 28 with a ball bearing 29 disposed thereon. The ball bearing 29 is configured for engagement on the control cam 24 and in the recess 25 of the control levers 22.

The working principle of the signaling mechanism 16 described above will be explained below with reference to FIGS. 5 to 12.

Figure 6:
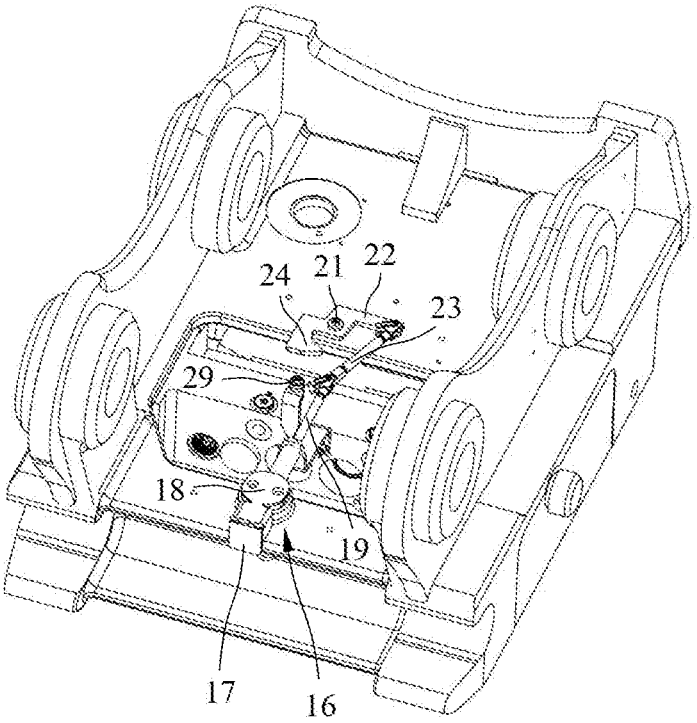
FIG. 6 the quick-change coupler device in the changeover position of FIG. 5.

In the changeover position illustrated in FIGS. 5 and 6, the two locking members 10 are in a retracted release position. In this position, the ball bearing 29, as shown in FIG. 6, is at a distance from the control cam 24 of the control lever 22, and the control lever 22 is pushed by the spring-loaded rod 19 via the jointed rod 23 into the basic position shown. The rod 19 is in a retracted position, which is why the flap-type signaling member 17 is in a downwardly folded unlocking position. This signals to the operator that the quick-change coupler device 1 is in a changeover position. In the changeover position with the retracted locking members 10, as illustrated in FIG. 5, the quick-change coupler device 1 on the front side can be downwardly lowered, so that the second coupling member 6 comes to abut on the lower abutment surface 11 of the receiving members 9.

When the second coupling member 6, as seen in FIG. 7, comes to abut the lower abutment surface 11 of the receiving members 9, the two bolt-shaped locking members 10, the front ends of which have a curvature 30 conforming to the outside contour of the coupling member 6 for abutting the outside surface of the bolt-shaped coupling member 6, can be extended through the shared cylinder 15 and reach the coupling position shown in FIG. 7. In this coupling position, the coupling member 6 is engaged from below by the two bolt-shaped locking members 10, and the adapter 2 is securely locked onto the quick-change coupler device 1.

Figure 8:
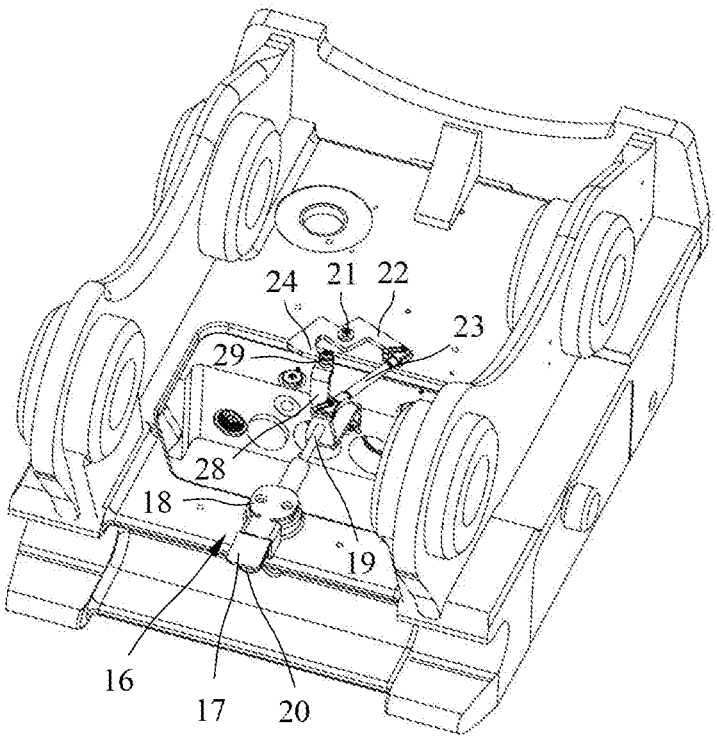
FIG. 8 the quick-change coupler device in the coupling position of FIG. 7.

If, with the adapter 2 correctly coupled, the two locking members 10 are moved through the cylinder 15 from their retracted release position 15 into the coupling position shown in FIG. 7, the lever 28, which is secured to the cylinder 15, along with the ball bearing 29, as shown in FIG. 8, latches onto the control cam 24 of the control lever 22, so that the control lever 22 is rotated about the hinge 21, and the flap-type signaling member 17 is moved via the joint lever 23 and the linearly movable rod 19 into the upwardly raised locking position. In the locking position illustrated in FIG. 8, the bolt 20 projects outwardly beyond the casing 18 and the flap-type signaling member 17 is raised upwardly. This signals to the operator that the adapter 2 is properly coupled to and locked into quick-change coupler device 1. The coupling gear is designed so that in the locking position shown in FIG. 8, the ball bearing 29 comes to abut the outermost edge of the control cam 24 at the junction to the recess 25.

Figure 9:
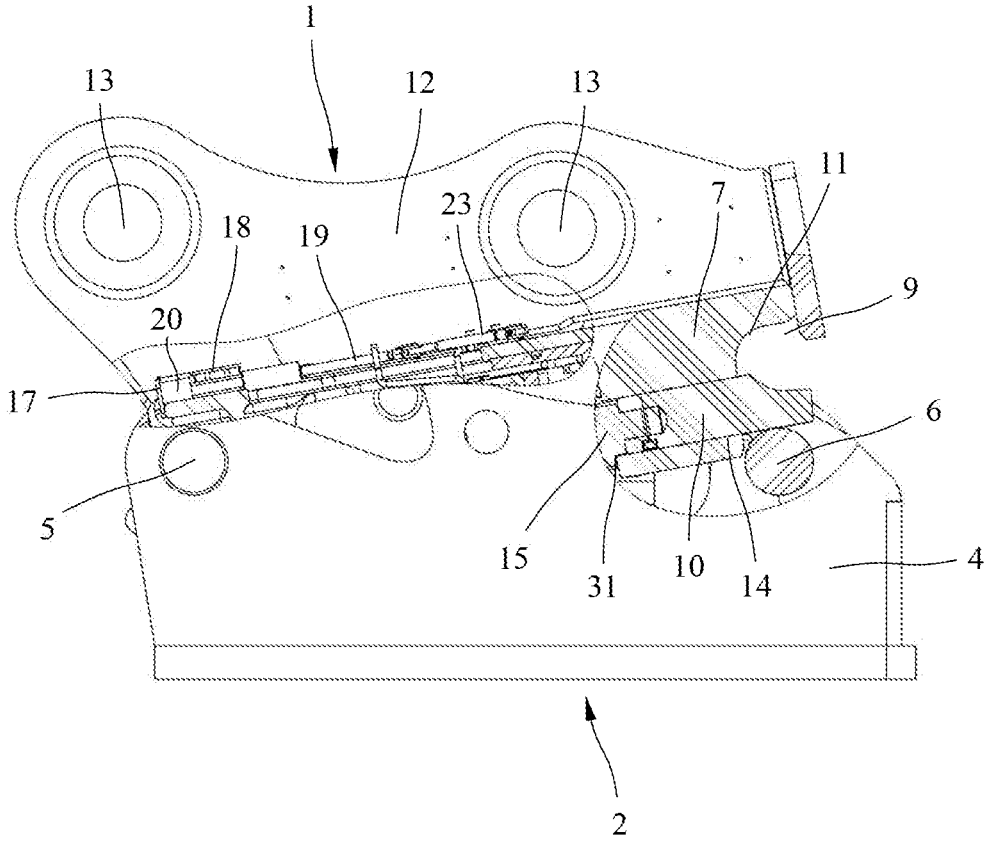
FIG. 9 a partially sectioned lateral view of the quick-change coupler system of FIG. 1 in an unlocked first position.
Figure 10:
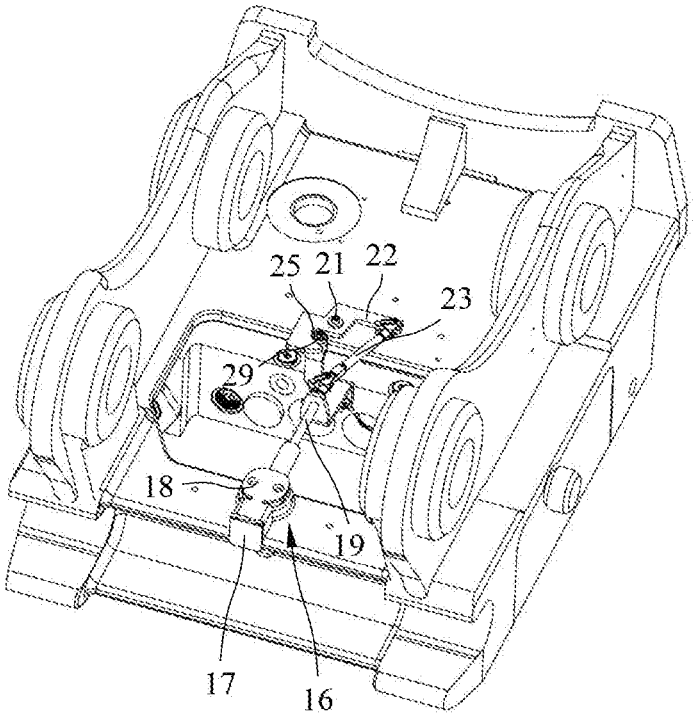
FIG. 10 the quick-change coupler device in the position of FIG. 9.

If, due to the failure of the coupling member 6 to be engaged in the receiving members 9, the bolt-shaped locking members 10, as shown in FIG. 9, move beyond the coupling position shown in FIG. 8 and extend up to the point at which the cylinder 15 strikes an edge 31 of the support member 7, the ball bearing 29, as shown in FIG. 10, reaches beyond the outermost edge of the control cam 24 and engages in the recess 25 of the control lever 22, which causes the control lever 22 actuated by the spring-loaded rod 19 via the jointed rod 23 to move back into the basic position. At the same time, the bolt 20 on the front end of the rod 19 is retracted into the casing 18, and the flap-type signaling member 17 is moved into the downwardly lowered unlocking position. This signals to the operator that despite the extended locking members 10, the adapter 2 is not properly locked onto the quick-change coupler device 1.

Figure 11:
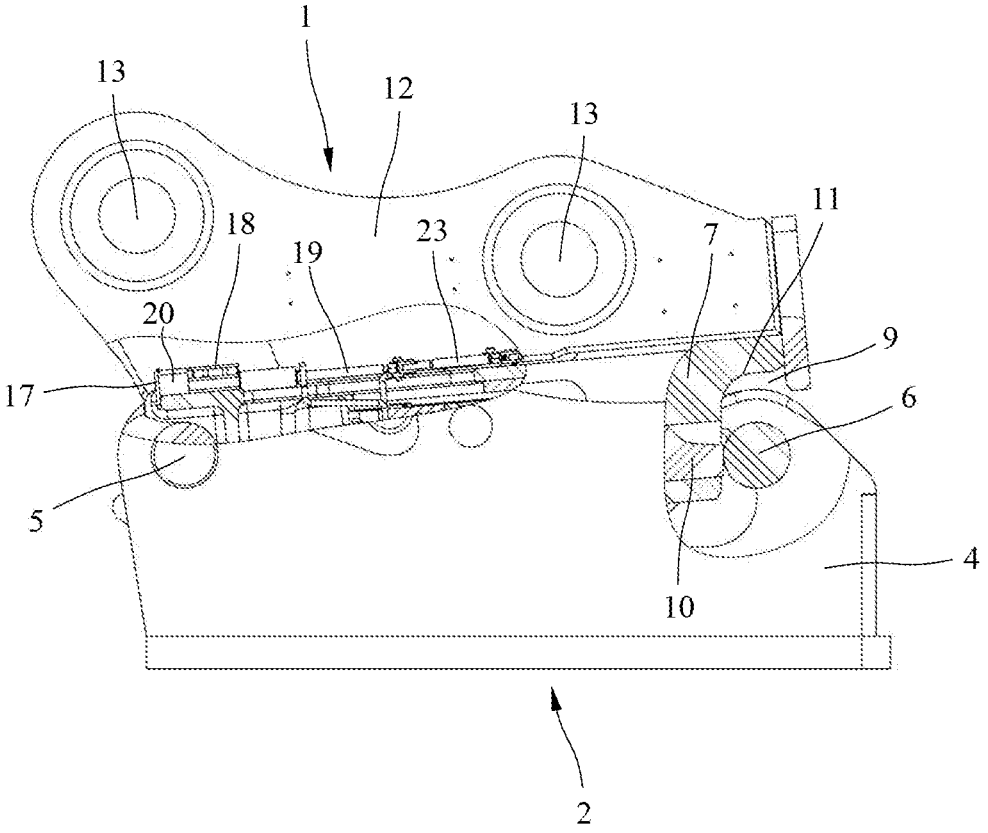
FIG. 11 a partially sectioned lateral view of the quick-change coupler system of FIG. 1 in an unlocked second position.
Figure 12:
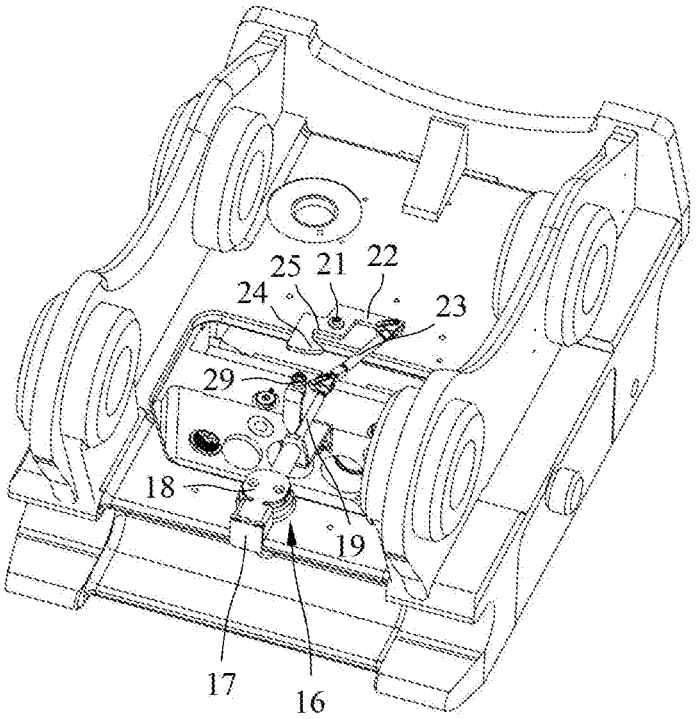
FIG. 12 the quick-change coupler device in the position of FIG. 11.

The operator is also alerted to a position shown in FIG. 11 in which the coupling member 6 is not properly engaged. If the two locking members 10 are prevented from extending outwardly because the coupling member 6 is not properly engaged, the ball bearing 29, as shown in FIG. 12, remains at a distance from the control cam 24 of the control lever 22, and the control lever 22 is pushed by the spring-loaded rod 19 via the jointed rod 23 into the basic position shown. The bolt 20 on the front end of the rod 19 is retracted into the casing 18, and the flap-type signaling member 17 is in the downwardly lowered unlocking position. This signals to the operator that the quick-change coupler device 1 is not properly locked.

Figure 13:
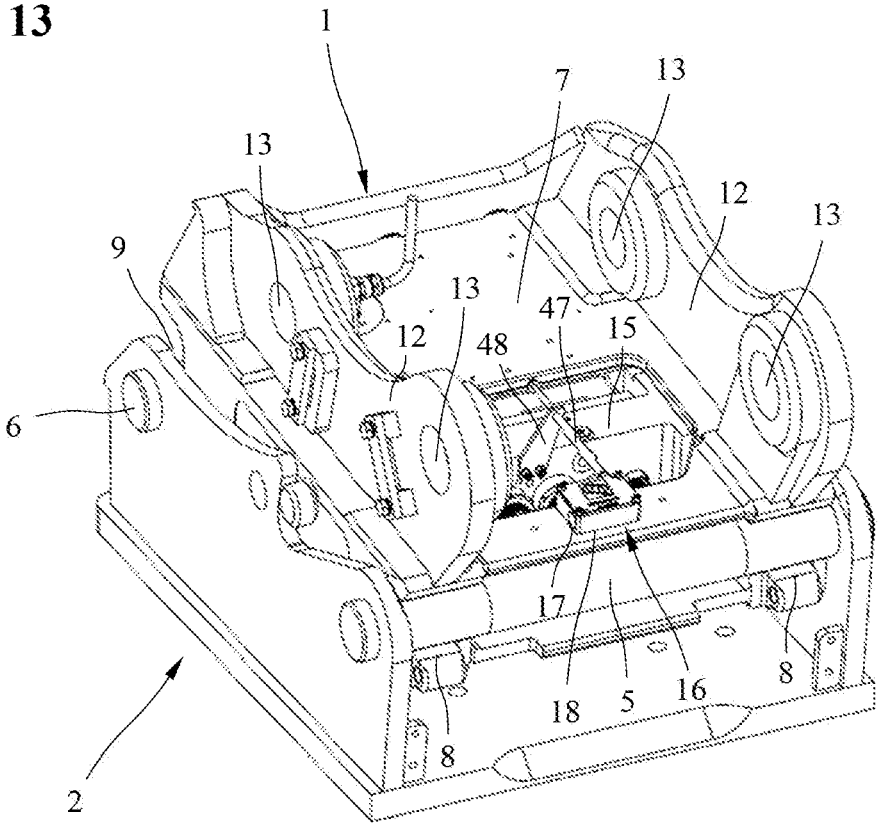
FIG. 13 a second embodiment example of a quick-change coupler system in a coupling position.
Figure 14:
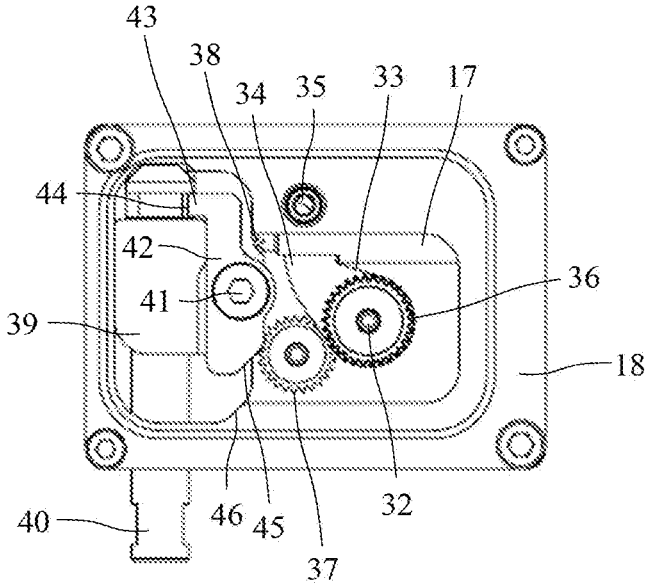
FIG. 14 an signaling mechanism of the quick-change coupler system of FIG. 13 in the coupling position.
Figure 18:
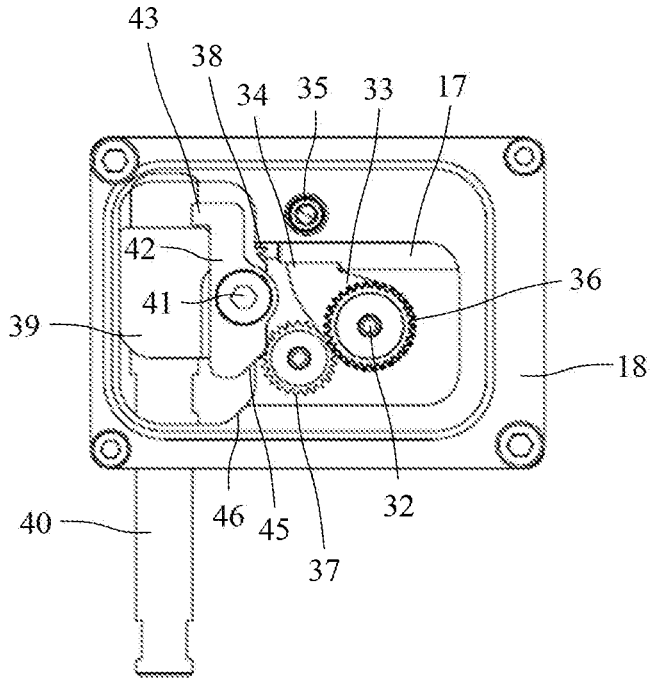

FIGS. 13 to 18 show a further embodiment example of a quick-change coupler system comprising a quick-change coupler device 1 and a dedicated adapter 2. In this implementation, the quick-change coupler device 1 again comprises a mechanical signaling mechanism 16 for monitoring proper engagement. The mechanical signaling mechanism 16 used in this implementation has a signaling member 17, in this case in the form of a bolt, which is disposed inside a casing 18 so as to be able to shift between a locking position and an unlocking position. In the locking position illustrated in FIG. 16, the bolt-shaped locking member 17 projects outwardly from the side of the casing 18 while the locking member 17, in an unlocking position shown in FIGS. 14 and 18, is retracted into the casing 18. When the locking members 10 move into the release or coupling position, the signaling member 17 in this implementation is again first moved into the locking position via a coupling gear. However, if, due to the failure of a coupling member 5 to be properly engaged, the locking members 10 move beyond the coupling position, the signaling member 17 is again moved back into the unlocking position via the coupling gear. This signals to the operator that, despite an actuation of the locking members 10, proper locking did not occur.

Figure 16:
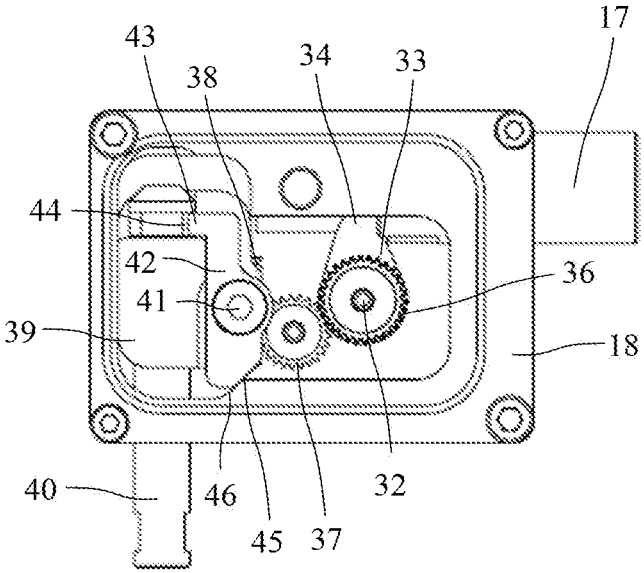
FIG. 16 the signaling mechanism of the quick-change coupler system of FIG. 13 in the locked position.
Figure 17:
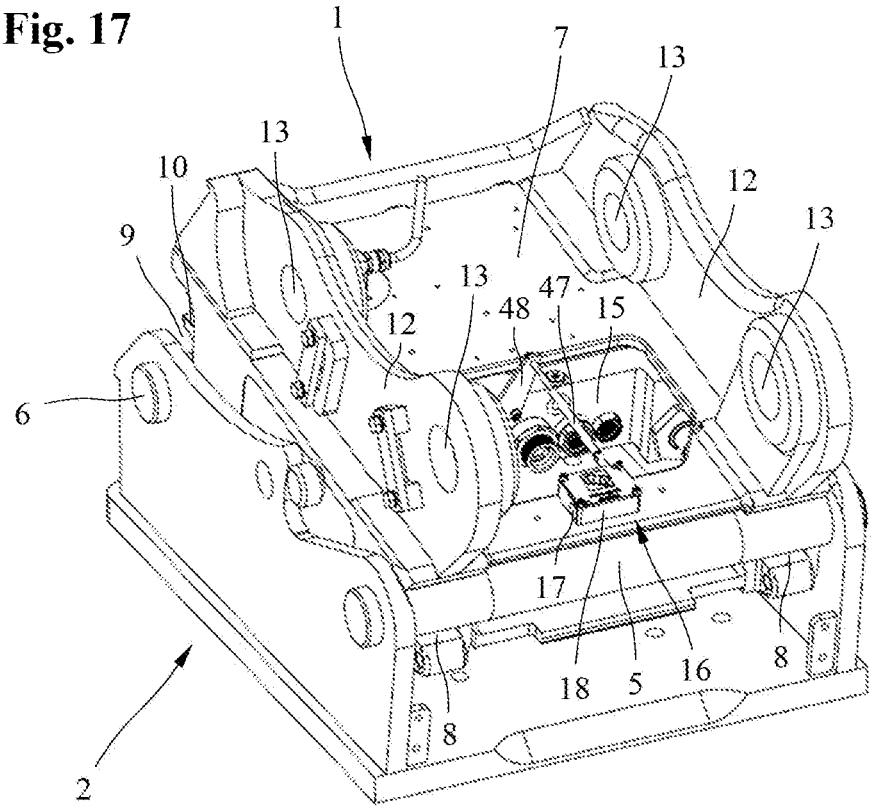
FIG. 17 the quick-change coupler system of FIG. 13 in an unlocked position and FIG. 18 the signaling mechanism of the quick-change coupler system of FIG. 13 in the unlocked position.

As FIGS. 14 and 16 indicate, the bolt-shaped signaling member 17, which is slidably guided inside the casing 18, can be moved by a lever 33 which is pivotably disposed about an axis of rotation 32 inside the casing 18. To this end, the lever arm 34 of the lever 33 that pivots about the axis of rotation 32 is hinged via a transverse pin 35 to the bolt-shaped signaling member 17. The lever 33 is rotated by means of a gear wheel 36, which is rigidly connected to said lever and which, via an idler wheel 37, meshes with a gear rack 38 on a carriage 39, which can move at right angles relative to the signaling member 17 inside the casing 18. Thus, by moving the carriage 39, the signaling member 17 can be shifted between the retracted position shown in FIG. 14 and the extended position shown in FIG. 16. By means of a spring assembly (not shown), the carriage 39 is actuated in such a way that the signaling member 17 is retracted into the casing 18 by the force of the spring assembly.

Slidably guided inside the carriage 39 is a rod-shaped actuating member 40, which is disposed at right angles relative to the signaling member 17 and which projects from the casing 18. In addition, a control lever 42, which pivots about an axis 41, is disposed on the carriage 39. The carriage 39 is detachably connected to the rod-shaped actuating member 40 via the control lever 42, which pivots about the axis 41. To this end, the control lever 42 has a lug 43 on one end of its lever arm for engaging in a groove 44 of the actuating member 40, and a guiding taper 45 on its other end for engaging with a sloped guiding plane 46 on the casing 18. By means of a spring (not shown), the control lever 42 is actuated in such a way that the lug 43 is pushed in the direction of the actuating rod 40. The actuating rod 40 is connected to the cylinder 15 via a linkage system 47 and a retaining member 48.

In the implementation shown in FIGS. 13 to 18, the signaling mechanism 16 is based on the following working principle:

In the changeover position shown in FIGS. 13 and 14, the cylinder 15 is in the position shown in FIG. 13, and the locking members 10 are in a retracted release position. The rod-shaped actuating member 40, which is connected to the cylinder 15 via a linkage system 47 and a retaining member 48, and the carriage 39, which is connected via the control lever 42 to this actuating member, are in a basic position shown in FIG. 14. In this basic position of the carriage 39, signaling member 17, which is connected to the carriage 39 via the gear rack 38, the idler wheel 37, the gear wheel 36 and the lever 33, is retracted into the casing 18. This signals to the operator that the quick-change coupler device 1 is in a changeover position. In this changeover position, the quick-change coupler device 1 can be connected at its the rear end via the first receiving members 8 to the first coupling member 5 of the adapter 2 and, on the front side, can be subsequently lowered downwardly so that the second coupling member 6 comes to abut the lower abutment surface 11 of the receiving members 9.

Figure 15:
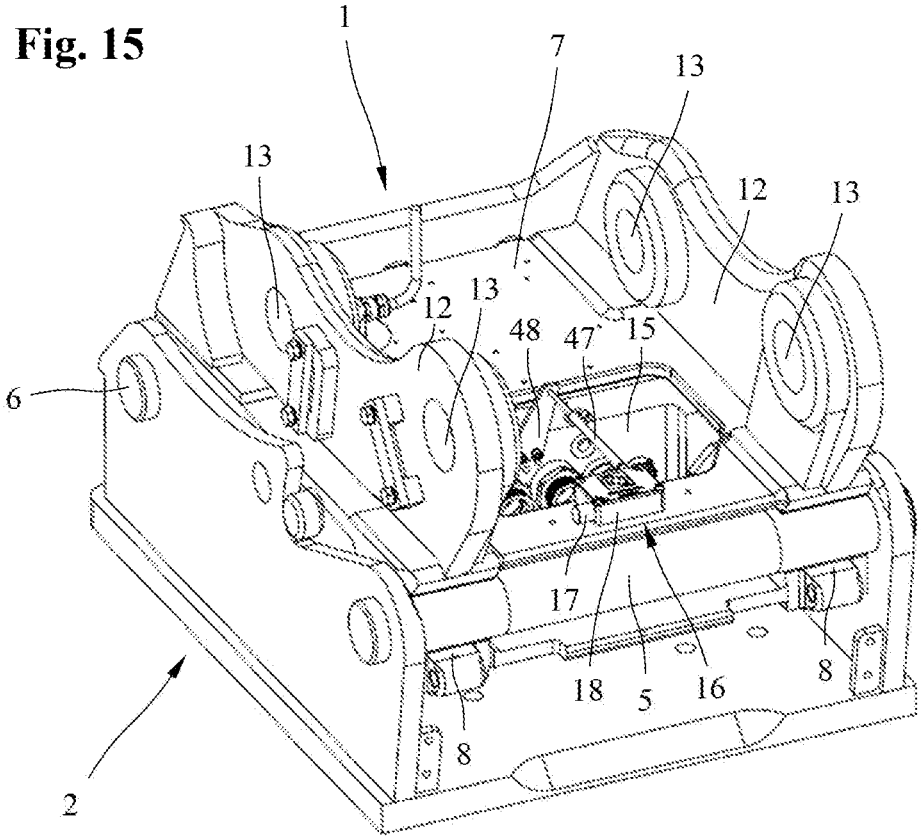
FIG. 15 the quick-change coupler system of FIG. 13 in a locked position.

If the cylinder 15, as seen in FIG. 15, is subsequently moved in the direction of the second coupling member 6 and the thereby moved locking members 10 are properly coupled to the adapter 2, the carriage 39 is moved by the actuating member 40, which is coupled via the control lever 42 to said carriage, from the basic position shown in FIG. 14 into a locking position shown in FIG. 16. In the locking position of the carriage 39 shown in FIG. 16, the control lever 42 is in its not yet swiveled coupling position. By shifting the carriage into the locking position, the signaling member 17 is moved via the gear rack 38, the idler wheel 37, the gear wheel 36 and the lever 33 into a locking position in which it projects outwardly beyond the casing 18. This signals to the operator that the adapter 2 is properly coupled to and locked into the quick-change coupler device 1.

If, due to the failure of the coupling member 6 to be engaged in the receiving members 9, the bolt-shaped locking members 10, as seen in FIG. 9, move beyond the coupling position shown in FIG. 8 and extend up to the point at which the cylinder 15 strikes an edge 31 of the support member 7, the carriage 39 also moves in the direction of the sloped guiding plane 46 on the casing 18. At the same time, the control lever 42 is moved via the guiding taper 45 in such a way that the lug 43 is disengaged from the groove 44 on the actuating member 40, and the carriage 39 and the actuating member 40 are no longer interlocked. Subsequently, the carriage 39, which is spring-biased in the direction of the basic position, is pushed via the spring assembly into its basic position, and the signaling member 17 is again retracted into the casing 18. This signals to the operator that despite the extended locking members 10, the adapter 2 is not properly locked onto the quick-change coupler device 1. When the quick-change coupler device 1 is opened, the cylinder 15 travels back, and the interlocking between the spring-biased control lever 32 and the actuating member 40 is re-established, so as to again connect the carriage 39 and the actuating member 40. The mechanical system of the quick-change coupler device is then again ready for use in the normal operating position.

LIST OF REFERENCE CHARACTERS

1 Quick-change coupler device
2 Adapter
3 Base plate
4 Side wall
5 First coupling member
6 Second coupling member
7 Support member
8 First receiving member
9 Second receiving member
10 Locking member
11 Abutment surface
12 Side section
13 Opening
14 Guide bores
15 Cylinder
16 Signaling mechanism
17 Signaling member
18 Casing
19 Rod
20 Bolt
21 Hinge
22 Control lever
23 Jointed rod
24 Control cam
25 Recess
26 Guide
27 Bushing
28 Lever
29 Ball bearing
30 Curvature
31 Edge
32 Axis of rotation
33 Lever
34 Lever arm
35 Transverse pin
36 Gear wheel
37 Idler wheel
38 Gear rack
39 Carriage
40 Actuating member
41 Axis
42 Control lever
43 Lug
44 Groove

45 Guiding taper
46 Guiding plane
47 Linkage system
48 Retaining member

The invention claimed is:

1. A quick-change coupler device for coupling and uncoupling an implement attachment to and from a construction vehicle, the device comprising:

a support member;

first receiving members disposed on one side of the support member for receiving a first coupling member;

second receiving members disposed on the other side of the support member for receiving a second coupling member, said second receiving members having at least one locking member which is moveable between a release position for coupling or uncoupling the implement attachment and a coupling position for retaining the implement attachment on the quick-change coupler device; and a mechanical signaling device for monitoring the locking status, wherein the mechanical signaling device comprises an assembly for signaling failure of the second coupling member to engage in the second receiving members, the assembly having a signaling member which is moveable between a locking position and an unlocking position, wherein the assembly comprises a coupling gear assembly for moving the signaling member into the locking position when the at least one locking member moves into the coupling position to thereby provide visual indication of the second coupling member engaging the second receiving members, and for moving the signaling member backwards into the unlocking position when the at least one locking member moves beyond the coupling position to thereby provide visual indication of the second coupling member failure to engage the second receiving members.

2. The quick-change coupler device of claim 1, wherein the coupling gear assembly comprises a control lever which pivots about a hinge on the support member and which is connected to the signaling member via a jointed rod and a linearly movable rod.

3. The quick-change coupler device of claim 2, wherein the control lever comprises a control cam and a recess.

4. The quick-change coupler device of claim 3, wherein the control cam and the recess are disposed on one arm of the control lever, and the jointed rod is disposed on the other arm of the control lever.

5. The quick-change coupler device of claim 2, wherein the control lever is rotatable through a cylinder for moving the at least one locking member via an actuating assembly.

6. The quick-change coupler device of claim 5, wherein the actuating assembly is formed by a lever having a ball bearing.

7. The quick-change coupler device of claim 2, wherein the linearly movable rod is spring-biased in a guide.

8. The quick-change coupler device of claim 2, wherein the signaling member is a flap, which is pivotally disposed in a casing and which is moveable between an upwardly raised locking position and downwardly lowered unlocking position via the linearly movable rod.

9. The quick-change coupler device of claim 1, wherein the coupling gear assembly comprises a carriage, which is connected to the signaling member via a geared drive assembly and which is moveable at right angles relative to the signaling member, and an actuating member which is detachably connected to the carriage.

10. The quick-change coupler device of claim 9, wherein the carriage is detachably connected to the actuating member via a pivotable control lever.

11. The quick-change coupler device of claim 10, wherein the control lever is a two-arm control lever, which is pivotably disposed about an axis on the carriage, has on one lever arm a lug for engagement in a groove of the actuating member and on the other lever arm a guiding taper for engagement with a sloped guiding plane on a casing.

12. The quick-change coupler device of claim 9, wherein the geared drive assembly comprises a lever which is rotatable by a gear wheel, an idler wheel meshing with the gear wheel, and a gear rack meshing with the idler wheel on the carriage.

13. A quick-change coupler system comprising the quick-change coupler device of claim 1 and an adapter which is coupleable to the quick-change coupler device.

* * * * *